United States Patent [19]

Prouty et al.

[11] Patent Number: 4,749,977

[45] Date of Patent: Jun. 7, 1988

[54] COIL MOUNTING ARRANGEMENT AND ITS METHOD OF MANUFACTURE

[75] Inventors: Robert E. Prouty; Ronald W. Goodrich, both of Logansport, Ind.

[73] Assignee: United Technologies Corporation, Hartford, Conn.

[21] Appl. No.: 675,105

[22] Filed: Nov. 26, 1984

[51] Int. Cl.[4] ..... H01F 7/08

[52] U.S. Cl. ..... 335/281; 335/276; 29/606; 29/602 R

[58] Field of Search ..... 335/128, 273, 276, 281, 335/278; 29/602, 606, 607

[56] References Cited

U.S. PATENT DOCUMENTS

| | | | |
|---|---|---|---|
| 2,500,748 | 3/1950 | Grant | 335/281 |
| 3,121,148 | 2/1964 | Wells et al. | 335/83 |
| 3,364,448 | 1/1968 | Willcox | 335/281 X |
| 3,544,936 | 12/1970 | Deforest | 335/281 X |
| 4,365,223 | 12/1982 | Fechant et al. | 335/281 |
| 4,596,972 | 6/1986 | Knight et al. | 335/281 |

*Primary Examiner*—George Harris

[57] ABSTRACT

A coil mounting arrangement includes a coil wound on a bobbin and in turn disposed about a core which is mounted to a frame. The frame includes a base portion and a leg portion which extends upwardly therefrom at a right angle. A support collar extends upwardly from the upper surface of the frame base portion and encircles a mounting opening which extends through the frame base portion. The core is inserted downwardly into press-fitted engagement with the frame within the support collar and mounting opening. Insertion continues until the height of the top of the core correlates directly with a position on the frame leg portion, such as the pivot axis of an armature. The underside of the frame base portion remains smooth.

7 Claims, 2 Drawing Sheets

COIL MOUNTING ARRANGEMENT AND ITS METHOD OF MANUFACTURE

TECHNICAL FIELD

The invention relates to a coil mounting arrangement and to the method of manufacturing such coil mounting arrangement for electromagnetic switches, such as relays and contactors, and to the method of their assembly.

BACKGROUND ART

Relatively small low cost electromagnetic switches, often referred to as relays and contactors and hereinafter referred to generally as relays, are well known, with representative examples being illustrated in U.S. Pat. No. 4,112,400 to Jaidinger et al and U.S. Pat. No. 4,423,399 to Goodrich. Such relays find utilization in a variety of applications but typically share several common objectives, including durability, relative compactness, and low cost to manufacture. These relays typically include a stamped, metal yoke or frame member, a magnetic core mounted on the frame member, a coil wound about a bobbin which is in turn disposed about the core, an armature and one or more electrical contacts selectively opened and closed by energization of the coil and resulting actuation of the armature.

More specifically, the frame has typically assumed either a U-shape or more often a L-shape, with a base portion and at least one vertically extending leg portion. The core has been securely mounted to the frame leg portion to extend upwardly in parallel with the frame leg portion. The armature is typically an elongated flat element which is in pivotal engagement with the frame leg portion and is movable relatively toward and away from the upper end of the core. Typically, a spring biases the armature to a position relatively away from the core and energization of the coil serves to draw the armature relatively toward the core. It is common in relays of this type to provide the pivotal mount for the armature by resting one end of the armature on an edge of the frame leg portion, which pivot edge extends in a plane which is substantially parallel to the frame base portion.

In assembling the core to the frame base portion, various mounting techniques have been employed. For example, U.S. Pat. Nos. 3,314,032 to Van Erden and the aforementioned 4,423,399 disclose arrangements in which a screw extends upwardly through an opening in the frame base portion and into threaded engagement with the lower end of the core. An alternate embodiment in the aforementioned U.S. Pat. No. 3,314,032 discloses an arrangement by which the lower end of the core is press-fitted into an opening in the frame base portion. That core includes one or more shoulders which limit the downward insertion of the core by engagement with the base portion. The lower end of the core is shown as being flush with the undersurface of the frame base portion, this result presumably being achieved by precise prepositioning of the core shoulder or by a finishing operation on the core end following insertion. In another example, U.S. Pat. Nos. 2,423,116 to Price and 4,112,400 mentioned earlier, disclose arrangements whereby a narrow stake end at the lower part of the core extends through an opening in the frame base portion and the downwardly projecting end is peened over to rigidly mount the core. In a further example, at least some of the T90 series of relays provided by the Potter and Brumfield Division of AMF, Incorporated, Princeton, Ind. mount the core to the frame base portion by first deforming the metal downward about an opening in the base portion to provide a downwardly extending support collar and then press-fitting the shank portion of a core into the base portion and support collar. A shoulder formed on the core limits downward insertion of the core and also determines the positioning of the top of the core.

While each of the aforementioned arrangements for mounting the core to the frame base may be adequate in accomplishing that general end, each possesses certain limitations which it may be desirable to avoid. Specifically, those constructions which use either a screw, a peened-over head or a downwardly-extruded support collar each include a projecting element on the undersurface of the frame base which may interfere with the smooth mounting of that surface to a support surface or housing.

Further, it is also important that the height of the upper end of the core be precisely established relative to that of the pivot axis or pivot edge of the frame leg portion to obtain the desired electromagnetic dynamics of the device. This objective might be accomplished by careful design and machining of the shoulder near the lower end of the core at which the core stake portion begins to accurately establish the distance from there to the core head. However, it has often been observed that the manufacturing tolerances in machining that shoulder into the core and in the smoothness of the upper surface of the core base portion itself and further in the positioning of the pivot edge in the frame leg portion often accumulate to frustrate such predesign. In such instance, it is even necessary to employ the use of shims about the stake at the base of the core and/or to make the pivot edge overly high on the frame leg and then machine it to the correct height following insertion of the core into the frame base.

DISCLOSURE OF INVENTION

Accordingly, it is an object of the invention to provide an improved coil mounting arrangement and specifically, an improved arrangement for mounting a core to a frame. Included in this object is the provision of a mounting arrangement which enables the undersurface of the base of a mounting frame to remain substantially smooth. Also included within this object is the provision of a method for mounting a core to a frame in a manner which provides the desired geometrical results while minimizing the manufacturing effort.

The foregoing and other objects of the invention are accomplished by an improved arrangement for mounting a core to the base portion of a frame member, as might typically exist in an electromagnetic relay of the type having a frame, a core mounted to the frame and a bobbin for supporting a coil and adapted to be mounted about the core. The frame includes a leg portion and a base portion extending generally transverse to the leg portion. A support collar extends upwardly from the upper surface of the frame base portion around a mounting opening in that frame base. The core has a base portion at its lower end which is mounted in interference-fitted engagement within the support collar in the frame base portion opening, and the head of the core is positioned upwardly therefrom. The undersurface of the frame base portion remains substantially entirely smooth. The depth to which the core is inserted into the support collar is determined not by the positioning of any shoulder on the core but rather by a direct relationship between the height of the top or head of the core and that of the pivot surface or pivot edge for an associated armature. Specifically, the core is urged downwardly into the support collar until that relation is determined directly, as by stop-limited engagement of the force-supplying insertion device with the pivot edge on the leg portion of the frame. The core is substantially cylindrical and preferably includes a region of smaller diameter near its lower end, thus forming a shoulder at the transition. However, the shoulder is positioned sufficiently far above the lower end of the core that it remains spaced above the frame base portion and the support collar when mounting of the core is completed.

BEST MODE FOR CARRYING OUT THE INVENTION

Figure 1:
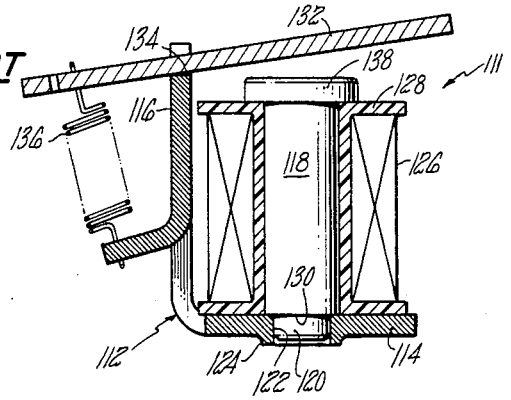
FIG. 1 PRIOR ART
FIG. 1 is a sectional view of a coil mounting arrangement illustrating a core mounted to a frame in accordance with the prior art.

Referring now to the drawings, FIG. 1 illustrates an electrical coil mounting arrangement 111 generally in accordance with the prior art. The coil mounting arrangement 111 includes a frame 112 formed from a ferromagnetic material and a base portion 114 and a leg portion 116 bent at right angles to each other. To simplify further references to the frame utilized in the coil mounting arrangements of both the prior art and the present invention, the frame base portion will be presumed to extend in a horizontal direction and the frame leg portion will be presumed to extend upwardly therefrom, however, it will be understood that various other orientations in which the frame base portion and leg portion remain at 90° to one another are also implied. A cylindrical core 118 of ferromagnetic material includes a reduced section or stake portion 120 at its lower end which is interference-fitted into an opening 122 extending through the frame base portion 114. To increase the area of the surface of the frame base portion 114 with which the core section 120 is in engagement, a downwardly-extending projection or support collar 124 is formed on the undersurface of frame portion 114 and surrounding opening 122. An electrical coil 126 is wound on a bobbin 128, which bobbin is then concentrically disposed about core 118. The core 118 is mounted on frame leg portion 114 by urging the core downward until the shoulder 130 at the upper end of section 120 engages the upper surface of frame base portion 114. An armature 132 is pivotally mounted to the frame leg portion 116 as along a relatively narrow pivot edge 134 formed on the frame leg portion 116. A tension spring 136 biases armature 132 away from the upper end or head 138 of core 118, and energization of coil 126 serves to actuate the armature 132 toward or to the core.

Figure 2:
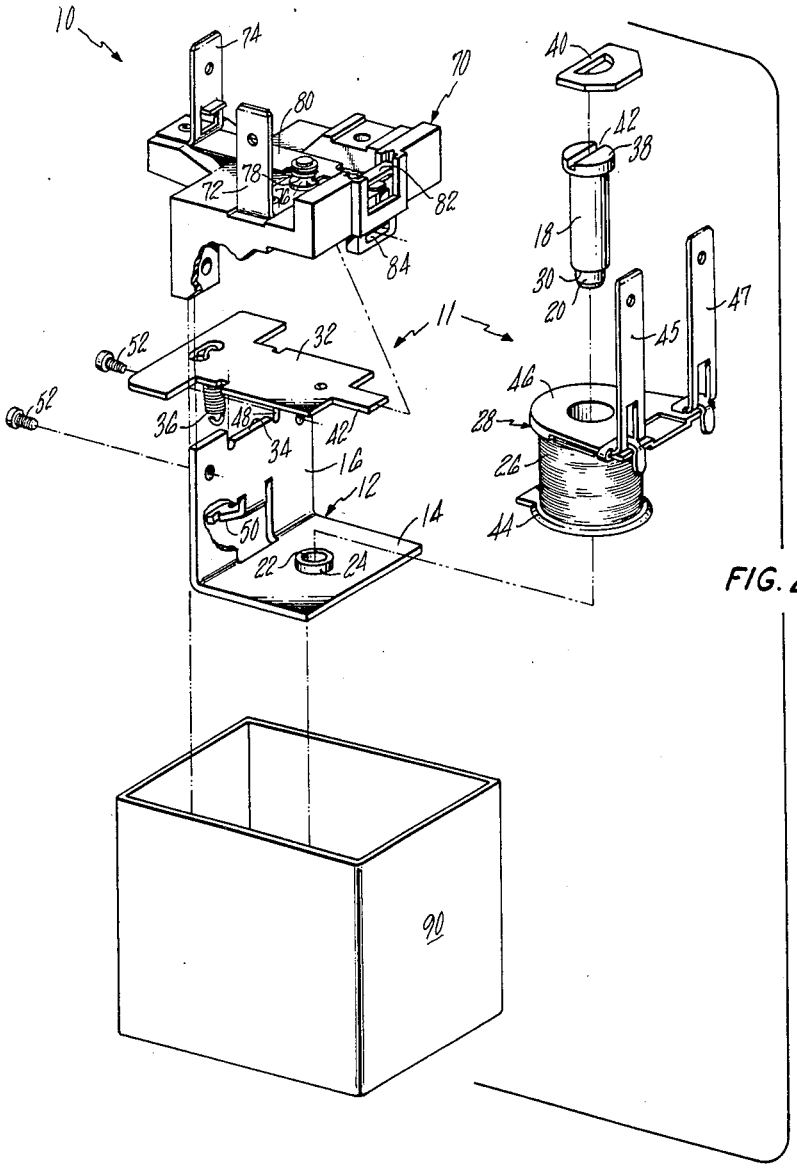
FIG. 2 is an exploded perspective view of an electromagnetic relay employing the core mounting arrangement of the present invention.

Referring to FIG. 2 there is illustrated an exploded view of an electromagnetic switch or relay 10 which includes a coil mounting arrangement, generally designated 11, in accordance with the invention. In addition to the coil mounting arrangement 11, the relay 10 includes a terminal and contact block 70 molded of a phenolic resin or other suitable insulation material. The terminal and contact block 70 mounts a first conductive terminal 72 and a second conductive terminal 74. A fixed contact 76 is mounted on terminal 72. A movable contact 78 is electrically connected with terminal 74 via a conductive contact spring 80 on which the contact is mounted. Spring 80 extends in cantilever fashion from the terminal 74 to an actuator 82 which is slidably mounted in a slot-like opening extending vertically through the terminal and contact block 70. A tongue 42 at the forward end of armature 32 is received in an aperture 84 in actuator 82 such that displacement of the armature is effective, via resultant displacement of the actuator 82, to displace the spring 80 and its contact 78 into and out of conductive engagement with contact 76 in the manner described in greater detail in the aforementioned U.S. Pat. No. 4,423,399. The relay 10 is conveniently contained within and supported by a housing member 90 typically being formed by an insulating material such as plastic and being adapted to be mounted to a support surface.

Referring to the coil mounting arrangement 11 in accordance with the invention, there is provided a frame 12 formed from a ferromagnetic material and having a base portion 14 and a leg portion 16 bent at right angles to each other. A generally cylindrical core 18 of ferromagnetic material is secured at its lower end to the frame base portion 14 in the manner to be described hereinafter in greater detail. A conventional shading ring 40 may be embedded in a slot 42 in the top or head end 38 of the core 18. An electrical coil 26 is wound about a bobbin 28 molded of nylon or other suitable insulation material between the end flanges 44 and 46 of the bobbin. A pair of terminals 45 and 47 are mounted on bobbin flange 46 and are each connected to a respective end of coil 26 for applying electrical energy thereto. An armature 32 extends through an opening 48 provided in the frame leg portion 16 and is pivotally supported on a pivot edge 34 of leg portion 16 for movement toward and away from the head of core 18. The pivot edge 34, and thus the pivot axis, extends in a plane which is substantially parallel to the plane of the frame base portion 14. The armature 32 is normally biased away from the core 18 by a tension spring 36 connected between one end of the armature and a lug 50 lanced out of the frame leg portion 16. The terminal and contact block 70 is secured directly to the frame leg portion 16 by screws 52.

Figure 3:
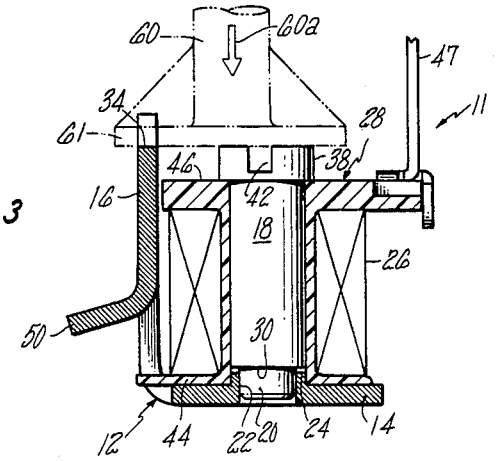
FIG. 3 is a sectional elevation view of a coil mounting depicting the assembly of the core to the frame in accordance with the method of the present invention.
Figure 4:
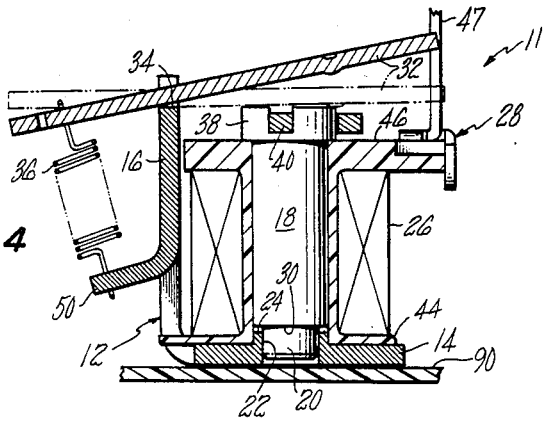
FIG. 4 is an elevation view, partly in section, of a completed coil mounting in accordance with the invention.

Referring to the mounting of core 18 to the frame leg portion 14 with additional reference to FIGS. 3 and 4, a circular opening 22 is initially formed through the frame base portion 14 as by a stamping operation. Subsequently, a portion of the metal of frame base portion 14 surrounding the opening 22 is extruded in an upward direction to form a support collar 24 which extends upwardly from the upper surfce of frame base portion 14. As used herein, "upwardly" means that it extends in the same direction as frame leg portion 116 extends from the frame base portion 14. The support collar 24 is typically formed by an extrusion operation in which an annular die is placed about the intended outer diameter of the collar and a metal-deforming pressure member of somewhat larger diameter than the original diameter of opening 22 is upwardly inserted into that opening to draw the metal upwardly to form collar 24. The resulting diameter of opening 22 is slightly increased during this operation. In an illustrative embodiment, the normal vertical thickness of frame base portion 14 is about 0.060 inch, the support collar 24 extends upwardly therefrom an additional 0.040 inch, the resulting diameter of the mounting opening 22 is about 0.187 inch and the outside diameter of the support collar 24 is about 0.25 inch.

The core 18 of the illustrated embodiment includes three sections or regions of different diameter, the largest diameter being at the head end 38 and being about 0.312 inch, the intermediate diameter extending for most of the mid length of the core and being about 0.250 inch and the narrowest diameter being at its lower end or stake portion 20 and being about 0.188 inch. The stake portion of core 18 is thus sized for interference-fitted engagement with the flange base portion 14 and support collar 24 within the mounting opening 22. A slight bevel or taper at the lowermost end of core 18 facilitates introduction of the core into the opening in support collar 24. The axial extent of the stake portion of core 18 is approximately 0.150 inch and is bounded at its upper end by an outwardly extending, downwardly-facing shoulder 30 which defines the lower end of the core midportion. The diameter of the opening extending through the coil bobbin 28 is only slightly larger than that of the midsection of core 18, being about 0.258 inch. The core 18 may thus be downwardly inserted through the central opening in bobbin 28 until the core head portion 38 rests against the upper flange 46 of the bobbin. With the bobbin 28 and coil 26 thus disposed about core 18, the stake portion 20 of the core is then introduced to the opening 22 in support collar 24 for insertion.

A force-applying member, as for instance represented by the broken line member generally designated 60, is connected to a suitable mechanism (not shown) for applying a force in the direction of arrow 60a to urge the core 18 downwardly into interference-fitted engagement with the frame base portion 14. The force applying mechanism continues to apply an inserting force to the member 60 and thus core 18 until a sensing arm 61 of the member 60 comes into limiting engagement with the pivot edge 34 on frame leg portion 16, whereupon further insertion of the core 18 is terminated. By such manner of assembly, the upper end of core 18 may be assured of having a precise predetermined positional relation or height relative to the pivot edge 34 of the frame leg portion 16.

In the illustrated embodiment the height of the top of core 18 and that of the pivot edge 34 are substantially identical such that the armature 32 will form substantially a 90° angle with the upper end 38 of core 18 when moved to its limit toward the core, as represented by the broken line illustration in FIG. 4.

Referring further to FIGS. 3 and 4, it will be noted that the diameter of the opening through bobbin 28 is slightly larger than that of the support collar 24 such that the lower flange 44 is allowed to rest against the upper surface of the frame base portion 14. Moreover, the shank portion 20 of the core 18 is of sufficient length relative to the maximum anticipated depth of insertion into opening 22 as to ensure that the core shoulder 30 does not engage the upper end of support collar 24 but remains spaced thereabove. On the other hand, the length of core shank portion 20 is not so long as to extend beyond the otherwise smooth undersurface of the frame base portion 14. Accordingly, the undersurface of frame base portion 14 remains smooth and is particularly suited for mounting against or support by additional supporting structure, as for instance a wall of the housing member 90.

Although this invention has been shown and described with respect to detailed embodiments thereof, it will be understood by those skilled in the art that various changes in form and detail thereof may be made without departing from the spirit and scope of the claimed invention.

Having thus described a typical embodiment of our invention, that which is claimed as new and desired to secure by Letters Patent of the United States is:

1. In an electromagnetic relay of the type comprising a frame including a leg portion and base portion of L shape, a coil assembly comprising a bobbin having end flanges and a coil wound about said bobbin between said flanges, a core secured at one end to said base portion and carrying said coil assembly, an armature pivotally mounted on said leg portion for movement toward and away from the other end of said core, and at least a pair of contact means actuated into and out of engagement by said movement of said armature, the improvement wherein:

said frame base portion includes a support collar extending upwardly from the upper surface of said base portion about a mounting opening in said base portion, with said core first end being cylindrical and being press-fitted into said support collar and said core other end being spaced upwardly therefrom, said press-fitted engagement of said core one end with said support collar affording, at least to a limited extent, variation in the extent to which said core one end is inserted into said support collar and wherein said core one end is inserted to such extent that said core other end is at a preselected position to said armature, said core other end and the pivot of said armature being relatively positioned such that said armature is at substantially 90° to said core other end when moved to its limit toward said core, and wherein said core includes an elongate cylindrical midportion of one diameter and said core one end extends longitudinally therefrom and is of lesser diameter, a shoulder being formed at the transition between said core diameters, and wherein the length of said core one end is such that said shoulder is spaced upwardly from said support collar when said core is mounted in said frame base portion.

2. The electromagnetic relay of claim 1 wherein the undersurface of said frame base portion is substantially entirely smooth.

3. The electromagnetic relay of claim 2 wherein said support collar is integral with said frame base portion and is formed by deformation of said base portion.

4. The coil mounting of claim 1 wherein the undersurface of said frame base portion with said core mounted thereto is substantially entirely smooth.

5. In an electromagnetic relay of the type comprising a frame including a leg portion and base portion of L shape, a coil assembly comprising a bobbin having end flanges and a coil wound about said bobbin between said flanges, a core secured at one end to said base portion and carrying said coil assembly, said core including a shank of reduced diameter at said one end, a downwardly-facing shoulder existing at the upper end of said core shank, an armature pivotally mounted on an edge of said leg portion, said pivot edge extending in a plane substantially parallel to said base portion, the method of securing said core to said frame base portion comprising the steps of:

forming an opening through said frame base portion;

deforming the material of said frame base portion adjacent to said opening relatively toward said leg portion pivot edge to provide a support collar extending beyond a surface of said frame base portion and being concentric with said opening; and inserting said core one end into interference-fitted engagement within said support collar, said insertion being continued until the other end of said core is in a precise position relative to said pivot edge of said leg portion and said shank being sufficiently long that said shoulder is spaced from said flange base portion and said support collar.

6. The method of claim 5 wherein said precise position of said core other end relative to said leg portion pivot edge is determined by inserting said core one end with a force applying member and wherein said force applying member is stop-limited by engagement with said leg portion pivot edge.

7. The method of claim 5 wherein said core is inserted into said engagement with said support collar in a direction relatively away from said leg portion pivot edge and toward said frame base portion, the length of said core and said precise positioning of said core other end further being such as to prevent said core one end from extending beyond the surface of the frame base portion opposite that surface into which it enters during said insertion.

* * * * *